United States Patent [19]

Smith

[11] Patent Number: 4,943,053

[45] Date of Patent: Jul. 24, 1990

[54] POST-OPERATIVE KNEE REHABILITATIVE DYNAMOMETER

[76] Inventor: Stephen H. Smith, R.D. 1, Box 150-B, Riegelsville, Pa. 18077

[21] Appl. No.: 289,587

[22] Filed: Dec. 22, 1988

[51] Int. Cl.[5] ..... A63B 21/02

[52] U.S. Cl. ..... 272/135; 272/130; 272/DIG. 5; 128/25 R

[58] Field of Search ..... 272/130, 93, 135, 125, 272/68, DIG. 5; 128/25 R, 25 B, 774, 779, 782; 73/379–381

[56] References Cited

U.S. PATENT DOCUMENTS

| | | | |
|---|---|---|---|
| 2,507,858 | 5/1950 | Kiegel | 272/93 X |
| 3,081,634 | 3/1963 | Blaszkowski | 73/379 |
| 4,048,985 | 9/1977 | Sasse | 73/379 |
| 4,114,449 | 9/1978 | Dikeman et al. | 73/379 |
| 4,216,956 | 8/1980 | Yamamura et al. | 272/DIG. 5 X |
| 4,530,496 | 7/1985 | Smith et al. | 73/379 X |
| 4,580,778 | 4/1986 | Van Noord | 73/381 X |
| 4,592,371 | 6/1986 | Pellicano et al. | 73/379 X |
| 4,653,514 | 3/1987 | Shapiro | 272/135 X |

*Primary Examiner*—Richard J. Apley
*Assistant Examiner*—H. Flaxman
*Attorney, Agent, or Firm*—Charles N. Quinn

[57] ABSTRACT

A device for measuring changes in human joint strength including an open cell body of light weight, low density polyurethane foam body, an air tight flexible skin sealed about the foam body, the skin including a multilayer vinyl material having an opening to permit passage of air into and out of the foam body, a hose sealed about the opening with a rubber seal, one end of the hose extending into a center portion of the foam body remote from the opening, the hose channeling air passing in and out of the opening, and a gauge connected to the hose for measuring the force of air passing through the hose upon application of force against the foam body.

7 Claims, 3 Drawing Sheets

POST-OPERATIVE KNEE REHABILITATIVE DYNAMOMETER

FIELD OF THE INVENTION

This invention relates to apparatus for measuring changes in human joint strength and particularly relates to apparatus for facilitating human knee joint rehabilitation through exercise and measuring changes in human knee joint strength during post-operative knee rehabilitation.

BACKGROUND OF THE INVENTION

Surgery on the human knee or knee joint nearly always requires rebuilding of muscular strength in the knee and/or in connective tissue surrounding the knee. Various methods and apparatus have been designed to facilitate rehabilitation of knee function. These typically include knee exercises designed to restore knee strength to previous or at least acceptable levels.

Most afflictions of the knee joint are exacerbated by weak quadriceps and hamstring muscles as the pateint begins to favor the painful joint. This many times initiates a vicious cycle of increased pain and increased muscle weakness leading to progressive joint instability. The quadriceps and hamstrings are the dynamic stabilizers of the knee joint and must be kept at maximum strength for optimal knee joint function.

Typical rehabilitative methods and programs extend over a period of time, usually measured in months, to achieve the desired level of recaptured knee strength. Measurements of knee strength are periodically taken to determine progress or completion of the required rehabilitation regimen. It has, therefore, become necessary to provide apparatus capable of measuring the relative restored knee joint strength to determine when it is possible or desirable to discontinue joint muscle strength rehabilitation.

Description of the Prior Art

Prior art known to applicant includes U.S. Pat. Nos. 3,791,375; 3,974,491; 4,286,603; 4,337,780; 4,521,186; and 4,592,371. Of these, '780 and '371 are believed to be the most relevant with respect to the invention disclosed and claimed herein.

'780 discloses a muscle testing apparatus and technique wherein an airtight bag is connected to a pressure responsive device by flexible tubing. The airtight bag is provided with elastic bands for attaching the bag and a pressure responsive gauge to the hand of the user. A second embodiment includes a small airtight bag, a large airtight bag, a two way valve and a pressure responsive device, all connected by flexible tubing. The small airtight bag has elastic bands for attachment to the palm side of one finger. The larger airtight bag has elastic bands for attachment to the palm of the user's hand. The user squeezes the airtight bag which exerts pressure through the tubing, thereby causing a pressure reading to be displayed on the pressure responsive device/gauge. '371 discloses a method and apparatus for muscle testing. An air bag is inflated by pumping air through a connecting hose by a flexible rubber bulb. A gauge attaches to the air bag by the flexible hose. To test the strength of a muscle or a set of muscles, the patient first applies force to the air bag. After inflating the air bag via a bulb, the applied force is measured by the gauge by the process being repeated. The gauge readings are compared to determine differences in muscle strength.

SUMMARY OF THE INVENTION

This invention encompasses apparatus for providing post-operative rehabilitation for a human knee joint through exercise and for simultaneously measuring changes in human joint strength, including an open-cell body of light weight, low density polyurethane foam and an airtight flexible skin about the foam body. The light weight low density polyurethane foam having the preferably air tight flexible skin about the foam provides apparatus for the human to rehabilitate the knee joint through post-operative therapy by providing a controlled amount of resistance to flexure and being of dimensions which are believed to be optimal for the quadricep setting exercise (which is the cornerstone of therapy for the knee disorders and knee post-operative rehabiltation).

The compression premitted by the low density polyurethane form enhances the exercise value when the apparatus is used for therapy. The skin preferably is dip molded elastomeric material and has at least one opening to premit passage of air to and from the foam body. A hose is sealed about the opening with a rubber seal. The hose is also connected along the length of the hose to the foam body, extending within the foam body. The hose preferably extends into a center portion of the foam body, remote from the opening, thereby channeling air passing in and out of the opening through the hose. A gauge attaches to the hose for measuring the force of air passing through the hose upon application of force against the foam body. The gauge connects to a rigid coupling member, which connects to the hose.

BRIEF DESCRIPTION OF THE DARWINGS

DESCRIPTION OF THE PREFERRED EMBODIMENTS AND BEST MODE FOR PRACTICING THE INVENTION

Figure 1:
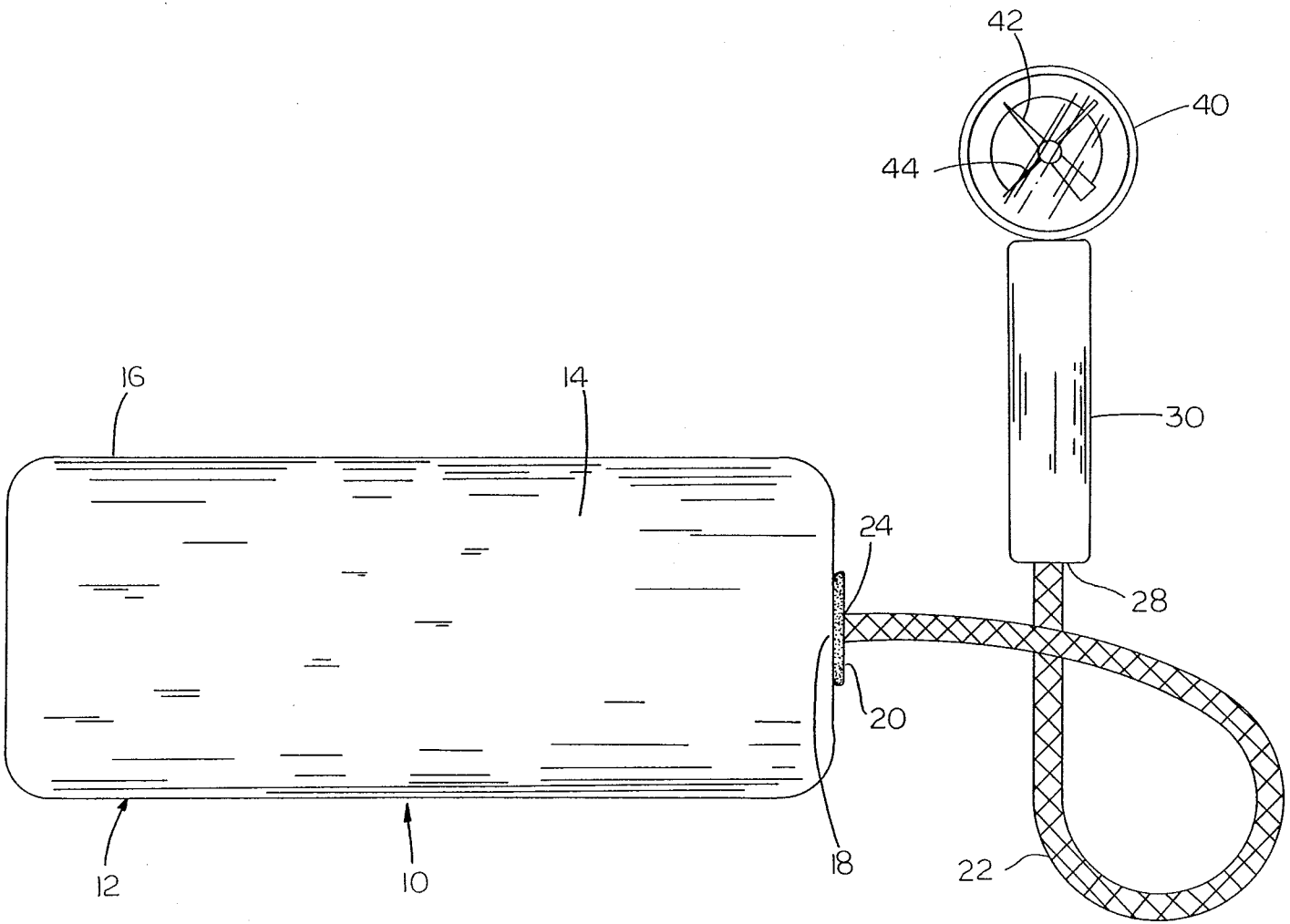
FIG. 1 is a schematic fron elevational view of apparatus in accordance with the invention.
Figure 2:
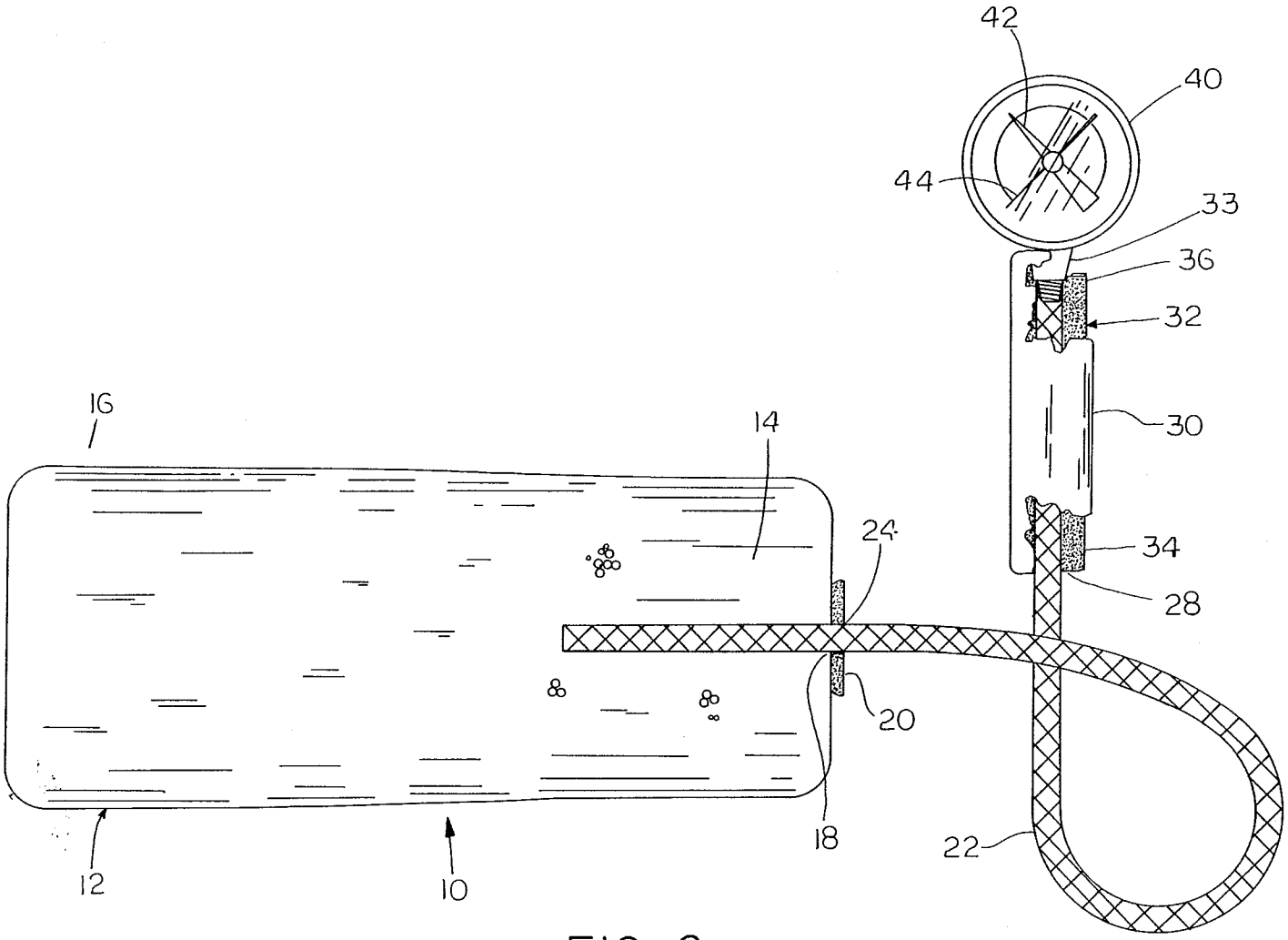
FIG. 2 is a schematic front elevational view of a preferred embodiment of the invention, partially taken in section.

Referring to the drawings in general and to FIGS. 1 and 2 in particular, apparatus for providing post-operative therapeutic exercise and for simultaneously measuring changes in human joint strength during post-operative knee rehabilitation is designated generally 10. Apparatus 10 includes pillow 12 consisting of a foam body portion 14 and a flexible outer skin 16. Skin 16 contains an opening 18 which is capped by and sealed to rubber grommet 20. Flexible tubing 22 extends inwardly into grommet 20 through grommet opening 24. Flexible tubing 22 is preferably sealed by cement to the foam body portion 14 of pillow 12 along the entire length of flexible tubing 22 which is within foam body 14 of pillow 12. In practice, flexible tubing 22 preferably extends about 4 inches into the foam body portion 14 and cement sealing of tubing 22 to foam body portion 14 is preferably provided along the entirety of the 4 inch tubing length which is with pillow 12.

The other end of flexible tubing 22 extends into bore 28 of a preferably foam grip member 30. A tubular coupling 32 is located within an surrounded by foam grip 30. Coupling 32 receives flexible tubing 22 at its lower end 34 with tubing 22 extending through bore 28. Upper end 36 of coupling 32 receives gauge mount 38 from gauge 40. Gauge mount 38 extends into and is received by the end of flexible tubing 22. Gauge 40 contains passive pointer 42 and active pointer 44. A cloth sleeve (not shown) may be placed over or around pillow 12 for sanitary and/or aesthetic purposes.

Referring to FIG. 2, a preferred embodiment of apparatus 10 is shown. Skin 16 is preferably created by dip molding, with foam body portion 14 being dipped into a suitable liquid phase elastomeric material so that the elastomeric material molds itself to the outer configuration of foam body portion 14. Foam body 14 consists of an open cell low density polyurethane.

Flexible tubing 22 extends into foam body 14, preferably to a middle portion of foam body 14. Although it is possible that flexible tubing 22 not extend to the middle of foam body 14, such placement assists in obtaining more accurate and consistent gauge readings. Additionally, having flexible tubing extending into the foam body 14 and being cemented along the length that flexible tubing extends into foam body 14 provides more secure attachment of flexible tubing 22 to foam body 14.

Referring now to FIGS. 1 and 2 generally, foam body portion 14 preferably consists of a generally cylindrically shaped piece of open-cell polyurethane foam. It is not necessary that any particular foam be utilized; however, it is preferred that the foam have a firmness rating of about 35–45 I.L.D. and a density of approximately 1.8 lbs/ft$^3$.

Pillow 12 is preferably about 12 inches long to enable the full width of the joint to contact the apparatus. The diameter of pillow 12 is most preferably about 4.75 inches to achieve about a 30 degree joint inflection prior to application of downward force by the joint on pillow 12. Skin layer 16 surrounding foam body 14 preferably is thin, most preferably having a thickness of between about 10 mils and about 22 mils. Pillow 12 is preferably formed having its edges, at either end of the cylinder, formed on about ⅝ inch radii.

The elastomeric material used to form skin 16 may be PDC-10 (manufactured by PDI, Inc. of St. Pual, Minnesota) consisting primarily of 1,1,1-trichloromethane, methylene chloride, petroleum distillates and toluene. PDC-10 has a low viscosity which enables it to easily fill pores and holes on the surface of foam body 14. This achieves the additional benefit of increased mechanical bonding of the skin to the foam body.

Skin 16 may, alternatively, be Flexabar brand vinyl material (manufactured by Flexabar Corp. of Northvale, NJ) consisting primarily of methyl ethyl ketone, methyl isobutyl ketone, toluol, red 2B pigment, dioctyl phthalate, isodecyl diphenyl phosphate and polyvinyl chloride copolymer. Skin 16 is most preferably applied by dipping pillow 12, but may be applied by other methods. Another preferred form of skin 16 comprises at least one layer of vinyl material containing rubber based balloons as a thicknening agent, at least one layer of vinyl based paint and a glass coat layer.

Flexible tubing 22 preferably consists of PVC tubing having reinforcement of nylon braids. Flexible tubing 22 is preferably connected to pillow 12 using a flat, washer-shaped Neoprene bushing or grommet. Foam grip member 30 preferably consists of a smooth bore sleeve of dip molded vinyl foam. Coupling 32, residing within foam grip member 30, preferably consists of a hollow wood dowel and connects to gauge 40 by gauge mount 38.

Gauge 40 preferably has a brass diaphragm, contains an all brass gear movement and has a brass pressure inlet with a restriction orifice. The gauge may have a scale range of about 0 to 100 inches of water or whatever scale range is desired for a particular application.

Figure 3:
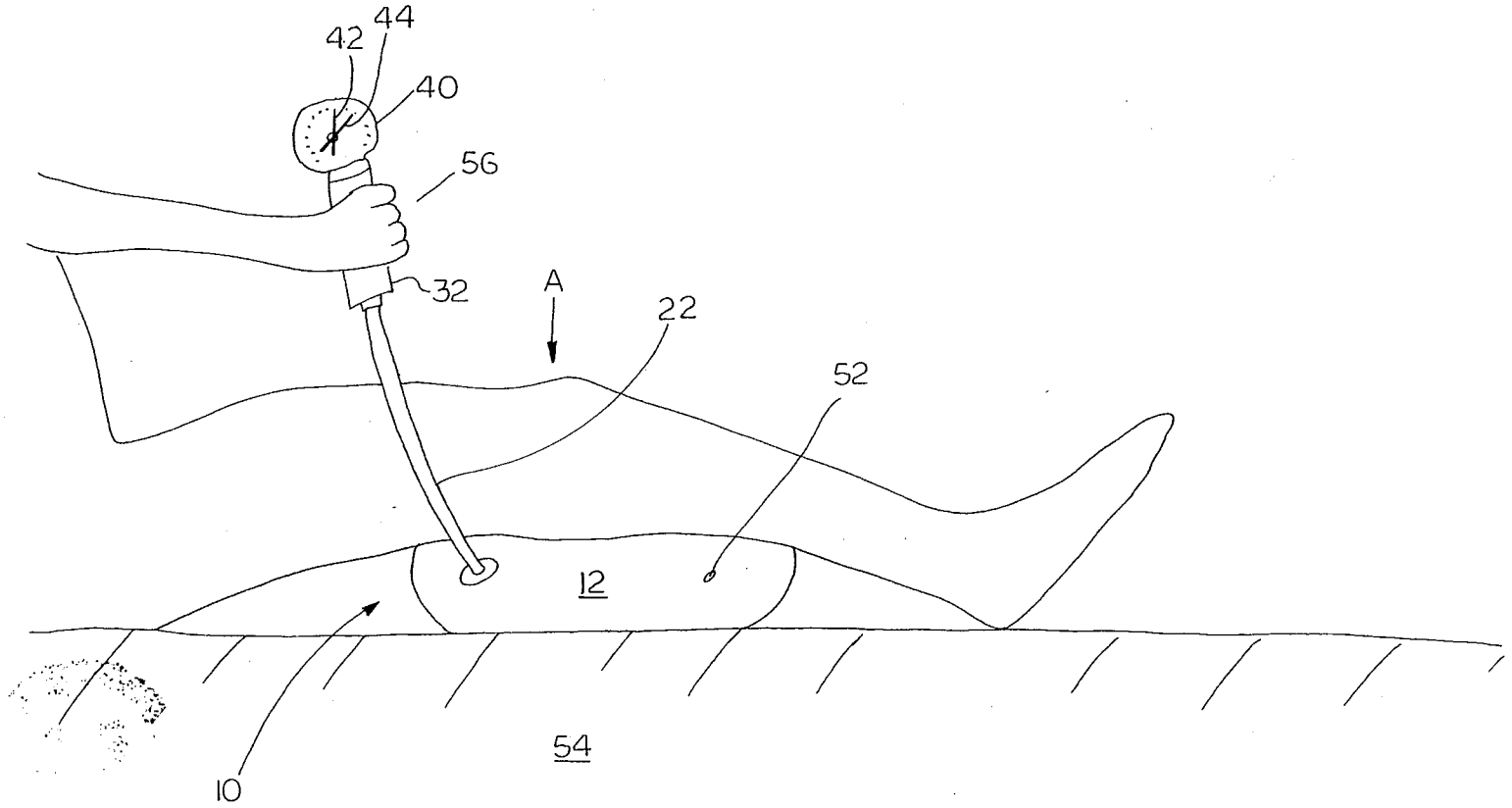
FIG. 3 is a schematic front elevational view of apparatus emboding aspects of the invention in use.

Referring now to FIG. 3, apparatus 10 facilitates rehabilitative exercise of the human knee joint provides improved measurement of changes in human joint strength during and resulting from rehabilitation of the joint. The most common joint for rehabilitation is the knee joint and it is the knee joint to which the invention is principally directed, although it is well within the scope of the invention to employ apparatus 10 in rehabilitation of other joints, such as the elbow, for example.

It is preferred to place apparatus 10 on a flat surface designated 54 in FIG. 3. The joint to be rehabilitated is then placed over the surface of foam body 12 opposing that in contact with flat surface 54. The preferred angle of joint flex is about 30°. The patient then grasps foam grip 32 with his or her hand 56 to facilitate reading pointers 42 and 44 on gauge 40.

The patient then applies downward force, in the direction shown by arrow A, using the joint being rehabilitated, to foam body 12. Application of downward force by the knee joint provides therapeutic exercise and rehabilitation for the knee joint. The subject can apply such downward force as many times as the subject likes or as prescribed by the attending physician or other health professional. Hence, apparatus 10 provides mechanical means for performing the rehabilitative exercise as well as means of measurement of the change in strength of the joint and associated supportive and connective tissue. The dimensions of the apparatus, set forth above, particularly the diameter of about four and three quarter inches, have been found to be optimal for the quadricep setting exercise, which is the cornerstone of therapy for knee disorders and post-operative knee rehabilitation.

Application of downward force on foam body 12 from above (by the joint) and simultaneous resistance to downward movement along surface 54 causes compression force in foam body 12, thereby compressing foam body 12. Air contained within the open cell structure of foam 14 is forced outwardly and exits foam body 12 by way of flexible tube 22. Exiting air then travels there through the gauge 40. The resulting air pressure within gauge 40 causes active pointer 42 to move along the face of gauge 40 to produce a reading.

Release of downward force by the joint releases compressive force on foam body 12, thereby releasing air pressure within gauge 40, coupling 32 and flexible tubing 32. Foam body 12 then returns to its original uncompressed state and volume. Repeated compression and decompression of foam body 12 enables utilization of passive pointer 44 to indicate a maximum amount of compressive force, thereby indicating maximum joint strength achievable during that rehabilitative session.

The above procedure may be performed repeatedly during the same rehabilitation session to obtain a range of measurements, and/or may be repeated periodically to determine changes in joint strength over time. The device, by providing both therapeutic exercise and rehabilitative therapy for the knee joint and permitting the physician or other health professional to monitor the patient's progress during rehabilitation, enhances the physician's or other physical therapist's ability to effectively rehabilitate the injured joint.

I claim:

1. A post-operative knee rehabilitative dynamometer comprising:

a. a cylindrically shaped open-cell body of light weight low density polyurethane foam body;

b. an airtight flexible skin having a thickness of about 10 to about 22 mils sealed about said foam body, said skin comprising at least one layer of vinyl material containing rubber based balloons as a thickening agent, at least one layer of vinyl based paint and a gloss coat layer, said skin having an opening to permit pasage of air into and out of said foam body;

c. a hose sealed about said opening with a rubber grommet and extending into the center of said foam body remote from said opening, said hose channeling air passing in and out of said opening;

d. means connected to said hose for measuring the force of air passing through said hose upon application of knee force against said foam body, comprising a gauge having an active and passive marker connected to one end of a coupling member, said coupling member being surrounded by a flexible foam hand grip and connected to said hose on its other end.

2. A post-operative knee rehabilitative dynamometer comprising:

a. a cylindrically shaped open-cell body of light-weight, low density polyurethane foam;

b. an airtight dip moled elastomeric flexible skin having a thickness of about 10 to about 22 mils molded and sealed about said foam body, said skin comprising at least one layer of vinyl material containing rubber based bolloons as a thickening agent, at least one layer of vinyl based paint and a gloss coat layer, said skin having an opening to permit passage of air into and out of said foam body;

c. a hose sealed about said opening with a rubber grommet and extending into the center of said foam body remote from said opening without extending completely through said foam body, said hose being sealed with cement to said foam body along at least a portion of the length of said hose within said foam body, said hose channeling air passing in and out of said opening; and d. means connected to said hose for measuring air pressure passing through said hose upon application of knee force against said foam body comprising a gauge having an active and passive marker connected to one end of a coupling member, said coupling member being surrounded by a flexible foam hand grip and connected to said hose on its other end.

3. Apparatus as defined in claim 2, wherein the foam has a density of 1.8 pounds per cubic foot.

4. Apparatus as defined in claim 2, wherein said foam has a firmness rating of about 35 to about 45 I.L.D.

5. Apparatus as defined in claim 1, further comprising a cloth sleeve surrounding said skin.

6. Apparatus as defined in claim 2, wherein said hose comprises PVC tubing having reinforcement of nylon braids.

7. A post operative knee rehabilitative dynamometer comprising:

a. a cylindrically shaped open-cell body of light-weight, low density polyurethane foam having a firmness rating of about 35 to about 45 I.L.D. and a density of 1.8 pounds per cubic foot;

b. an airtight dip molded elastomeric flexible skin comprising a material selected from the group consisting of (i) at least one layer of vinyl material containing rubber based balloons as a thickening agent, at least one layer of vinyl based paint and a gloss coat layer, (ii) 1,1, 1-trichloromethane, methylene chloride, petroleum distillates and toluene and (iii) methyl ethyl ketone, methyl isobutyl ketone, toluol, red 2B pigment, dioctyl phthalate, isodecyl diphenyl phosphate and polyvinyl chloride copolymer, said skin having an opening to permit passage of air into and out of said foam body;

c. a cloth sleeve surrounding at least a portion of said skin;

d. a hose sealed about said opening with a rubber grommet and extending into the center of said foam body remote from said opening without extending completely through said foam body, said hose comprising polyvinyl chloride tubing having reinforcement of nylon braids and being sealed with cement to said foam body along at least a portion of the length of said hose within said foam body, said hose channeling air passing in and out of said opening;

e. means connected to said hose for measuring air pressure passing through said hose upon application of knee force against said foam body comprising a gauge having a brass diaphragm, brass gear movement, a brass pressure inlet with a restriction orifice, a scale with a range of 0 to 100 inches of water and an active and passive marker connected to end of a hollow wooden dowel coupling member, said coupling member being surrounded by a flexible foam hand grip and connected to said hose on its other end.

* * * * *